US005621637A

United States Patent [19]

Spahlinger

[11] Patent Number: 5,621,637

[45] Date of Patent: Apr. 15, 1997

[54] METHOD OF CONTROLLING THE QUALITY IN THE PRODUCTION OF A PLURALITY OF YARNS

[75] Inventor: Jorg Spahlinger, Unterweg, Germany

[73] Assignee: Barmag AG, Remscheid, Germany

[21] Appl. No.: 309,806

[22] Filed: Sep. 21, 1994

[30] Foreign Application Priority Data

Sep. 21, 1993 [DE] Germany ..... 43 32 002.3
Oct. 19, 1993 [DE] Germany ..... 43 35 590.0

[51] Int. Cl.[6] ..... G06F 19/00

[52] U.S. Cl. ..... 364/138; 364/470.01; 364/470.15; 364/470.1

[58] Field of Search ..... 364/470, 468, 364/131–136, 138, 139, 552, 468.01, 470.01, 470.1, 470.14, 470.15; 57/264, 265

[56] References Cited

U.S. PATENT DOCUMENTS

| | | | |
|---|---|---|---|
| 3,922,642 | 11/1975 | Tooka | 364/470 X |
| 4,408,447 | 10/1983 | Sloupensky et al. | 364/470 X |
| 4,720,702 | 1/1988 | Martens | 340/677 |
| 4,720,806 | 1/1988 | Schippers et al. | 364/551 |
| 5,017,911 | 5/1991 | Muller et al. | 340/677 |
| 5,018,390 | 5/1991 | Muller | 73/828 |
| 5,046,013 | 9/1991 | Ueda et al. | 364/470 |
| 5,055,829 | 10/1991 | Stuttem et al. | 340/677 |
| 5,124,928 | 6/1992 | Aemmer | 364/470 |
| 5,161,111 | 11/1992 | Oehler et al. | 364/470 |
| 5,381,340 | 1/1995 | Ueda et al. | 364/470 |

FOREIGN PATENT DOCUMENTS

| | | |
|---|---|---|
| 0439106 | 7/1991 | European Pat. Off. . |
| 0453890 | 11/1991 | European Pat. Off. . |
| 0541483 | 10/1992 | European Pat. Off. . |
| 4209203 | 3/1992 | Germany . |

*Primary Examiner*—Joseph Ruggiero
*Attorney, Agent, or Firm*—Bell, Seltzer, Park & Gibson, P.A.

[57] ABSTRACT

A method of controlling the quality during the production of a plurality of yarns in a corresponding number of identical processing stations (4, 5, 5') is disclosed. This method allows at least one signal (10, 10', 10") to be detected simultaneously and continuously in all processing stations (4, 5, 5') of such a production line, as well as to acquire at least one additional signal (7, 8, 9, 11) in one or more processing stations (4), the so-called reference stations. By correlating all signals acquired in these reference stations, the result of the correlation is evaluated based on the knowledge of possibly existing interdependencies, with respect to one or more typical properties of the furnished product. It is possible to determine therefrom set values for the further influencing of the process in the reference station as well as to obtain indications of the quality of the product.

20 Claims, 4 Drawing Sheets

METHOD OF CONTROLLING THE QUALITY IN THE PRODUCTION OF A PLURALITY OF YARNS

BACKGROUND OF THE INVENTION

The present invention relates to a method of controlling the quality in the production of a plurality of yarns in a corresponding number of processing stations which are similar to one another.

For the production of synthetic filament yarns, it is customary to employ production lines, which consist of a plurality of similar processing stations, each of which realizes similar and simultaneously occurring processing steps. Each of the similar processes is determined by a plurality of influence variables, the sum of which defines the quality of the yarn produced at each processing station.

A method of monitoring the quality in the production of a plurality of yarns is known from EP 0 439 106 A1, wherein in the production of a synthetic filament yarn that is textured by the false twist method, the individual processing station is monitored, in that the reference signal is obtained from measuring the process parameters of a plurality of production stations.

The simplest form of evaluation consists of forming a mean value, which rates all processing stations equally. The mean value of all processing stations will then allow an indication of the quality of the entire process or product to be obtained. However, as an absolute value, this indication is not necessarily correct, but is dependent on the condition of the processing stations. If the course of the process in all processing stations is shifted uniformly relative to the actually intended condition, the formation of the mean value will not result in any significant deviations of the processing stations from one another. As a result, the uniformity of the mean value appears to be indicative of the presence of a desired course of process, whereas the entire process itself does not proceed in a desired manner.

It is the object of the present invention to provide a method which achieves, with reasonable measuring and evaluation resources, a substantially uniform and equally good control of the production processes in all stations of a multiposition textile machine.

SUMMARY OF THE INVENTION

The above and other objects and advantages of the present invention are achieved in the embodiments described herein by the provision of a method for controlling the quality in the production of a plurality of yarns in a corresponding number of identical processing stations, and comprising the steps of continuously and simultaneously measuring at least one process parameter in each processing station of the production line; comparing a process parameter or a characteristic value derived from a process parameter of a least one selected processing station with the corresponding desired value or desired characteristic value; determining a control signal on the basis of the comparison; supplying the determined control signal to all processing stations so as to control an identical control element at all of the processing staions and determining a quality value for each processing station by correlating at least one process parameter measured therein with a reference signal.

The further development in accordance with the invention represents the comparison of the process parameters (measured values) in all processing stations with a so-called reference station, whose course of the process is assumed to be representative of a course of the process to be adjusted for optimal performance. In so doing, it is attempted at this reference station to come close to the respectively intended course of the process by a controlled influencing of the process parameters. It is then possible to conclude by comparing the common process parameters of each individual station with the reference station, as to how close the actual course of the process comes to the actually intended course of process, and to determine therefrom a quality signal for the evaluation of the produced yarns. Likewise, all processing stations are uniformly controlled with respect to the decisive parameters.

The reference value, which allows an expected deviation of the yarn characteristic to be determined, is obtained from the affected processing station. As an alternative to this, the control signal is used as reference value, which allows the decisive process parameter of the reference station to be controlled. Both alternatives ensure a time-related indication of the process control in the individual processing station.

The limitation of the process observation in the reference station to only one process parameter (often the course of the yarn tension), however, does not allow the actually possible quality of the process observation to be obtained, which could in fact be obtained from the knowledge of the dependencies of individual process parameters as well as the technological possibilities of a measurement from the evaluation of further process parameters.

A measurement of many of these influence variables in each reference station allows to determine with adequate accuracy the condition of the entire process, and to influence it with respect to the quality of the produced yarns.

The resources required for measuring the process variables, as well as for evaluating the obtained process data increases with the number of reference stations. For example, should it be desired to determine all relevant process variables on a textile machine with 216 processing stations, it will be necessary to incur in all processing stations the same expenditure for apparatus, as well as to process simultaneously the data from all 216 processing stations. The costs necessary therefor are not justifiable for a practical application. The limitation to one or a few reference stations will however reduce the apparatus expenditure considerably.

In one embodiment of the invention, a method of controlling the quality in the production of a plurality of yarns in a corresponding number of similar processing stations is described, the method being applicable in the textile machine regardless of the kind of the actually applied production process or further processing process.

All processing stations of the production line are equipped with measuring devices, which allow at least one signal to be continuously detected via measured values, which are especially indicative of the course of the process in the particular processing station.

Besides these data acquisition devices which are present in each processing station, at least one additional signal on the condition of the process is acquired in one or in few processing stations of the production line, so as to obtain more accurate indications of the actual course of the process. In so doing, it is possible to acquire both directly controllable process parameters and variables which are only indirectly indicative of the process.

All these variables, which are acquired both in the individual processing stations and in one or more reference stations are signaled to a principal or central evaluation unit, which determines, if need be, likewise indicative characteristics which are derived from the acquired data. Simultaneously known to this central evaluation unit are possibly existing dependencies of the measured data or the derived characteristics, so that it is possible to obtain from the individual values by a suitable correlation an indication of the process condition in the reference stations or the processing stations.

As a further step of the evaluation, the correlation results are examined by an automatically proceeding evaluation in the central evaluation unit with respect to one or more typical properties of the product (for example dyeability, evenness of the yarn during the winding cycle, etc.), and set points are derived therefrom for a further influencing of the individual or the few reference stations. Moreover, it is possible to obtain indications of the quality of the product in the processing stations. An indication of the quality of the product in each processing station may be obtained based on a quality value. The quality value may be determined by a comparison of the process parameter or parameters with predetermined desired values, or by a comparison with the process parameters of the reference station or stations.

The central point in the control of the quality of the produced yarns in a multiposition textile machine is the uniformity of properties in the yarns produced in all processing stations. To this end, control variables are determined from the exact knowledge of the course of the process in the reference station or stations, which predetermine the individual, desired process parameters in all processing stations of the multiposition machine in identical manner. The way of determining the control variables is dependent on the process applied at the time. The reference stations are viewed to be representative of the course of the process in the entire production line, and conclusions are drawn therefrom for the control of the other processing stations.

In the evaluation of the measured parameters of the reference station signals as well as the signals from the individual processing stations, tolerance ranges are defined, which surround each of the mean values of the measured parameters, and the width of which delineates the allowable deviations from a desired value. As a result, primarily high-frequency portions of measured value signals are eliminated, which otherwise would adversely affect the indicative strength of the measured signals for the evaluation.

Since in such a control of the production line, there is only little influence on the control of an individual processing station, it is necessary to cause the central evaluation unit to react, when one of the measured parameters or a value derived therefrom leaves the permissible range of values. Should such a behavior occur longer than a short time in one of the processing stations or the reference station, it will be necessary to stop this processing station or to identify it as defective. If in a production line with only one reference station, same is affected by the deviation of a measured parameter, it will be necessary to stop or check the entire production line.

Central task of the principal evaluation unit is to control the process-dependent parameters of the processing stations such that it is possible to realize the desired, product-specific properties in their cumulative effect. In the instance of a multiposition textile machine, the focus is on the uniformity of the production results throughout all processing stations. Based on the typical further processing of a plurality of fully wound packages to corresponding end products, the properties of the individual packages should vary only minimally with respect to further processing operations. Besides this objective of realizing an as uniform as possible production result, it is natural to also check and ensure the quality of each individual yarn or the quality of the fully wound package produced on each processing station.

To realize this object, a greatest possible variety of measurements is conducted in the reference stations with respect to the properties of the product or the course of the process. In so proceeding, it is possible to use both individual parameters or measuring values, and combinations of at least two parameters or measuring values for monitoring the course of the process. Typically, but not limited to the following listing of such measuring values, the following process parameters are measured as a function of the process applied at the time, and used for examination:

Yarn tension prior to winding;

Contour of the wound package;

The so-called K value, namely the ratio of traversing frequency to the rotational speed of the package, by means of suitable measuring methods (in this instance, primarily also an indirect measurement of this frequency ratio via signals as a result of a typical yarn behavior); and Modulus of elasticity of the produced yarns. Besides measuring individual parameters along the path of the advancing yarn within a processing station, it is also possible to arrange several, similar sensors, or similar combinations of different sensors simultaneously at different points of the yarn path within a processing station. Such combinations permit changes in the yarn during its advance to be detected and acquired. It is possible to determine therefrom, if need be, further descriptive characteristics of the process.

Within a production process, the knowledge of the variation of individual signals with time allows to also draw conclusions as to a typically occurring wrong behavior of the yarn or individual process parameters in the processing station. If one examines now individual typical signal patterns or combinations of typical signal patterns for such ways of behavior, it will be possible to identify these undesired ways of behavior by means of suitable comparison methods to relate them back, if need be, to certain machine components of the production line. The identification of typical frequencies within the signal patterns permits, for example, a correlating frequency of moved machine parts to be interred therefrom.

If in the reference station or stations, a plurality of signals are gathered, which allow to draw conclusions as to the process control of the entire production line, the central evaluation unit will conversely have to control in the other processing stations a plurality of control devices and to supply same with identical control variables. This direct influencing of the individual processing stations based on signals from the reference stations will allow to realize an as accurate as possible process control in the individual stations, while taking into account the aforesaid uniformity.

Besides the direct control of the production process, it is possible to also draw from the acquired and correlated or evaluated measuring signals conclusions as to the quality of the packages produced in each individual processing station. To this end, the production qualities of the individual packages are determined by an automatic evaluation and documentation, and associated to same automatically as a characteristic during or after completion of the production process.

BRIEF DESCRIPTION OF THE DRAWINGS

Further advantages, features, and uses of the present invention will become apparent from the following description of embodiments with reference to the drawings, in which.

DETAILED DESCRIPTION OF THE PREFERRED EMBODIMENTS

Figure 1:
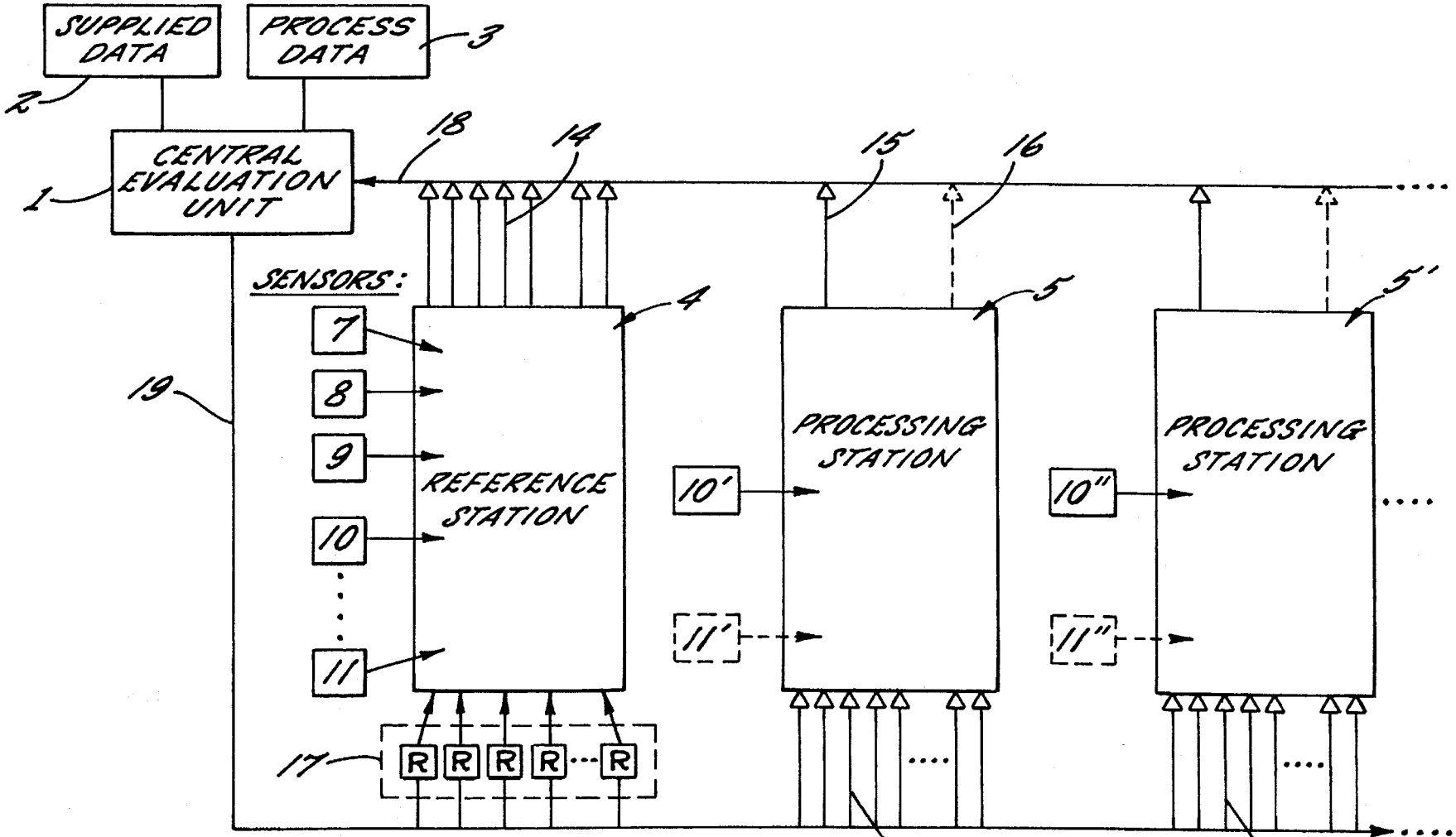
FIG. 1 illustrates a typical setup of a system for controlling the quality in the production of yarns.

Shown in FIG. 1 is a possible embodiment for the quality control of a multiposition textile machine in accordance with the concept of the present invention.

The multiposition textile machine consists of a plurality of similar processing stations, which are illustrated in FIG. 1, as follows:

A reference station 4 for acquiring the exact data of the course of the process. In the place of only one reference station, it is possible to also employ a small number of further reference stations.

Further processing stations of an undetermined number, which are shown in this Figure, for example, by processing stations 5, 5'.

Common to all processing stations is the monitoring of the course of the process by a sensor 10 or 10' (frequently employed to measure the yarn tension), and, if need be, few additional sensors 11 or 11' or 11". The data from these sensors are transmitted, for example, as a yarn tension signal 15 or as signals of further measured data 16 to a principal evaluation unit 1. In addition, one may install in reference station 4 further devices for measuring such data, as the package contour 7, the K value 8, and the modulus of elasticity 9, as well as further process sensors 11 (frequency analysis, etc.). The signals from these measuring devices are transmitted as miscellaneous measuring signals 14 likewise to the central evaluation unit.

The central evaluation unit 1 is now in charge of determining derived values from the measured data, and to correlate all signals simultaneously obtained from the measuring elements.

For the evaluations which proceed automatically in this evaluation unit, it is necessary that the evaluation unit be supplied with data such as desired production characteristics 2, as well as actually occurring process dependencies 3. Based on these input data, as well as on a corresponding, automatically proceeding conclusion logic, the central evaluation unit 1 is able to make indications of the process condition in reference station 4, as well as in processing stations 5, 5', . . . With reference to the known process sequences, these indications lead to inputs with respect to the process control of both reference station 4 and processing stations 5 and 5'.

These control data are supplied to the different processing stations in different ways. Since all reference stations are to be influenced to the greatest extent possible, they are locally controlled via secondary control circuits 17. Consequently, the central evaluation unit inputs in these local control circuits (preferably a separate control circuit for each control variable), desired values for influencing the process. The local control circuits see to corresponding variations of the process control. The process parameters are again measured via sensors 7–11 and signaled back as measuring signals to the central evaluation unit 1. Thus, the process is tracked in a quality control circuit with respect to the quality of the furnished product.

In the place of the desired values used in the reference stations, all other processing stations 5, 5', . . . receive directly control variables for influencing the different process parameters. They are control variables 12 or 13 which are supplied to processing station 5 or 5'. Also here, the process in the processing station is influenced based on the input of predetermined control variables. Same are measured via sensors 10' or 10" and, if need be, 11' or 11", and again transmitted back to the central evaluation unit via signals 15 and possibly 16. Thus, a quality control is present in these processing stations, which is however based on the optimized process control in the reference stations and the quality control realized therein.

Thus, the quality control is built up and kept in operation by means of signal line 18 for transmitting the measured data back as well as by the output of control variables or desired values via parameter input line 19.

Of central importance for a product-specific quality control are the desired product characteristics 2, as well as the process dependencies 3 as are present in a process. Same are input, depending on the particular process, in central evaluation unit 1, and they contain, in the ideal case, all characteristic values required to realize an optimal production result. These input data may be predetermined or modified both by the manufacturer of the quality control system, and by the user of the quality control system. This allows to achieve a far-reaching adaptation of the process control to modified production procedures.

Figure 2:
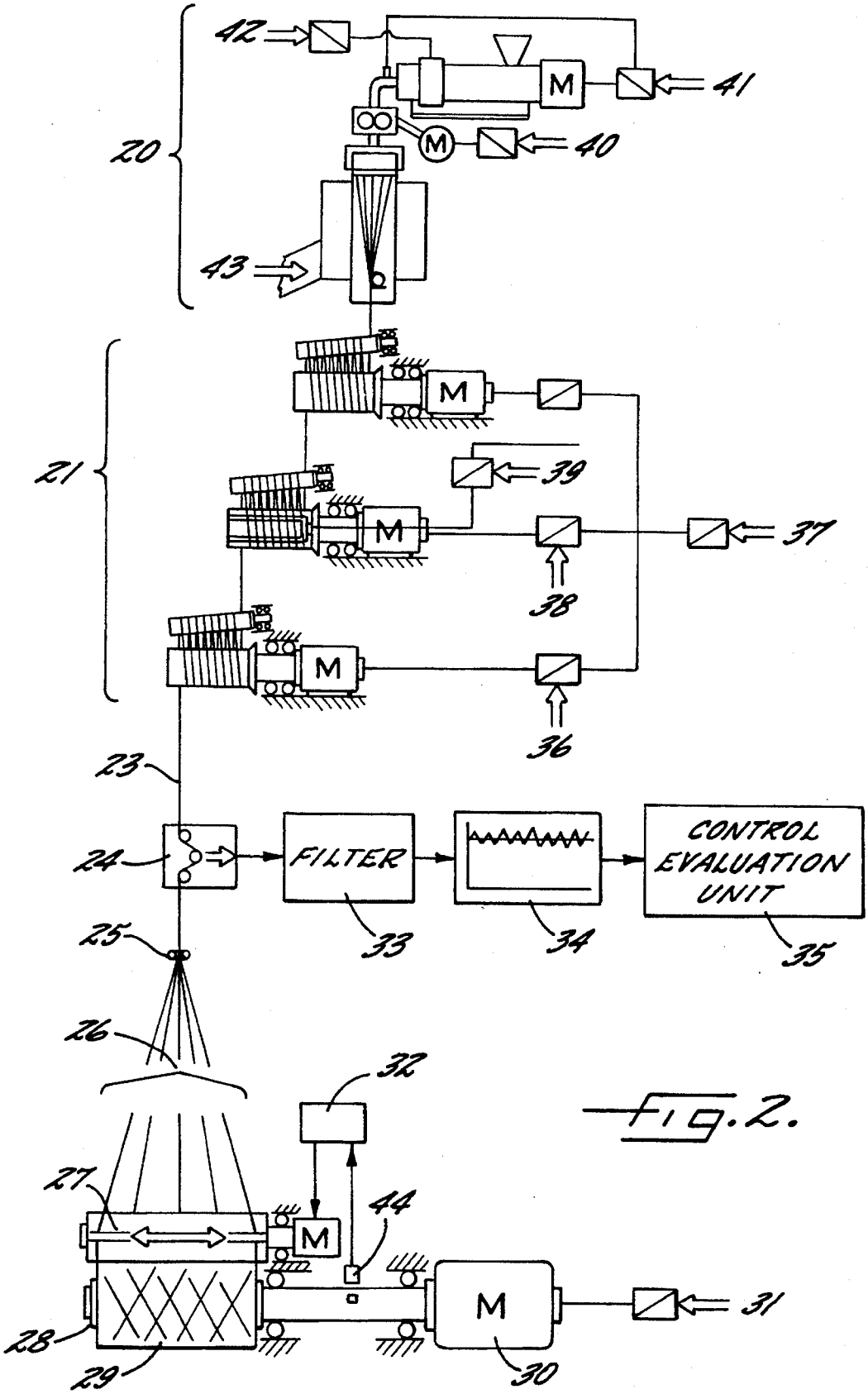
FIG. 2 illustrates a typical production process of synthetic filament yarns.

Shown in FIG. 2 is a typical arrangement for the production of a package of a synthetic fiber. A yarn 23 is withdrawn by means of a godet arrangement 21 from an extrusion and spinning unit 20, and wound on an empty tube by means of a yarn traversing mechanism 27. In godet arrangement 21, the yarn receives by corresponding measures its desired, physical properties, such as tensile strength, elasticity, denier, and others. The yarn may be also advanced through texturing devices not shown, so as to realize desired surface characteristics.

After this actual production and finishing of the yarn, the latter is wound to a package in a takeup device shown in the lower portion of FIG. 2. To this end, the continuously withdrawn yarn 23 advances over an apex yarn guide 25 to a traversing mechanism 27, which reciprocates the yarn for winding, initially over rotating empty tube 28, and thereafter on rotating package 29. A drive 30 necessary to rotate the yarn package is controlled via a control device 31, so that the circumferential speed on the package surface remains always constant. The frequency of the yarn traversing mechanism is predetermined via a drive motor which is controlled by a control device 32. The adjustment between the rotation of winding spindle motor 30 and the frequency of the yarn traversing mechanism is realized by synchronization, with traversing control device 32 receiving the rotational speed of the winding spindle from a speed measuring instrument 44. The selection of suitable laws of traversing allows to obtain desired properties for the deposit of the yarn on the package.

Interposed between godet arrangement 21 and yarn traversing mechanism 27 or apex yarn guide 25 is a yarn tensiometer 24, which enables a constant measuring of the yarn tension. The yarn tension signal is freed, via a filter 33, from disturbing high-frequency oscillations, and transmitted as a graphic recording 34 of the tension to an evaluation unit 35.

The central evaluation unit 35 is responsible for controlling all actuating elements used in the process so as to realize an optimal course of the process. Actuating or control elements used in this process include primarily:

| | |
|---|---|
| 31 | Control element for the package drive; |
| 32 | Control element for the traversing mechanism drive; |
| 36–38 | Control elements for the godet arrangement; |
| 39 | Control elements for the godet heating; |
| 40 | Control element for the metering pump; |
| 41 | Control element for the extruder speed; |
| 42 | Control element for the extruder heating; |
| 43 | Control element for the cooling air current. |

The careful adjustment of all these control elements is prerequisite for producing a satisfactory yarn as well as for realizing the desired yarn properties.

Figure 3:
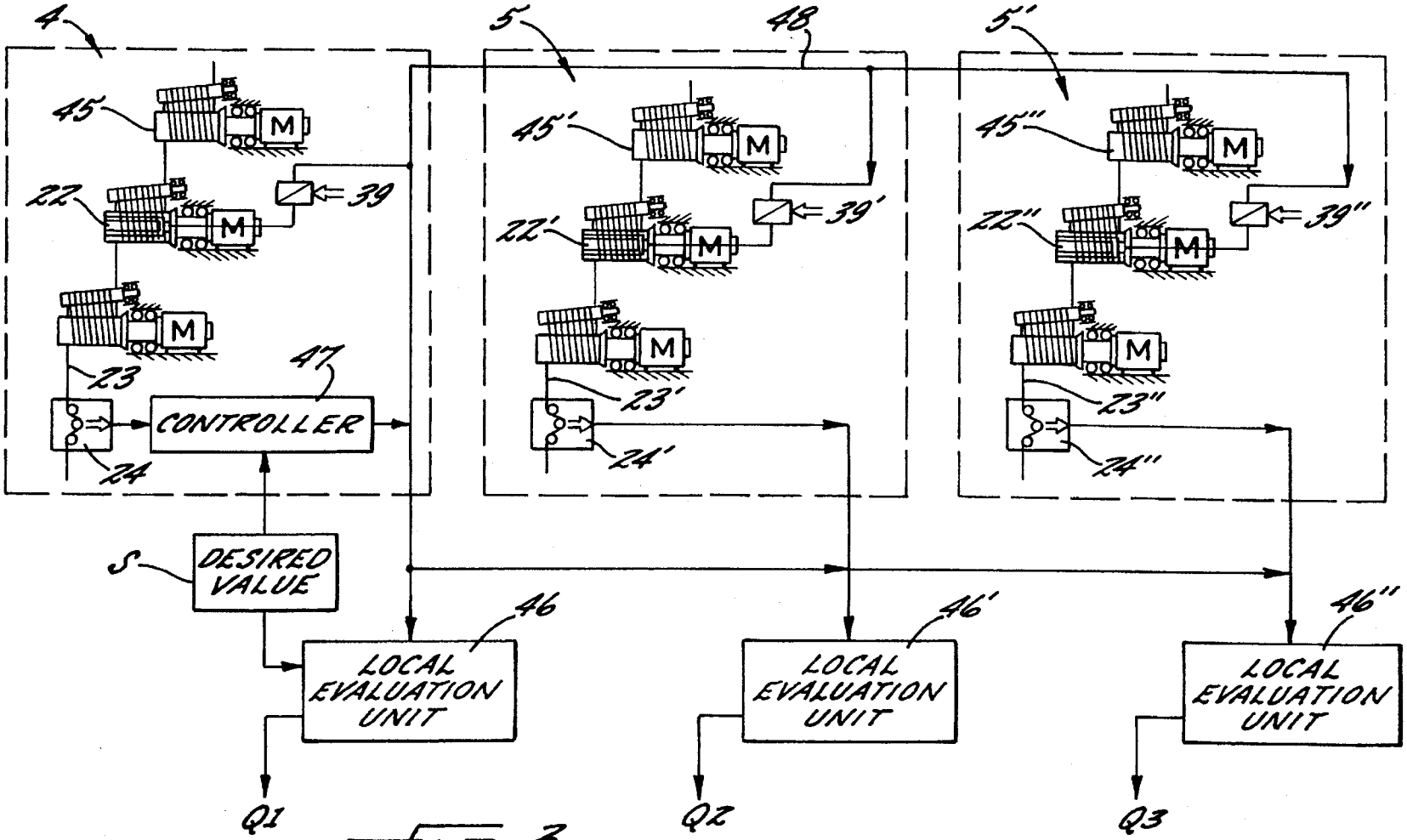
FIG. 3 illustrates a typical temperature control by means of heated godets used in the production of synthetic filament yarns in accordance with FIG. 2.

FIG. 3 is a schematic view of three processing stations 4, 5, and 5'. In each of the processing stations a yarn 23, 23', or 23" is produced. The illustration in FIG. 3 is a detail view of the entire process shown in FIG. 2, with the godet arrangements and yarn tension measurement being illustrated in detail. It may however be likewise a processing station in any desired other machine for producing a synthetic yarn, for example, a false twist crimping machine. Within the scope of the present application, production is understood to include not only the spinning, but also the processing of the yarn.

In each of the processing stations, the yarn is withdrawn by a godet 45, or 45' and 45" from its actual production zone. After passing the godets, each yarn advances through a yarn tension sensor 24, or 24' and 24", which consists of a yarn deflection guide and the actual sensor.

The godets 22 or 22' or 22" are heated. This heating allows to influence the yarn tension, which is measured by the respective sensor 24, 24', and 24". In processing station 4, the measured yarn tension is controlled simultaneously. Therefore, the processing station 4 is used as reference station. The measuring parameter, namely the yarn tension is predetermined by a controller 47. The controller 47 generates a control signal 39 for the control of the heating as a function of a desired value S. This control with adjustment of the temperature of godet 22 allows to keep the yarn tension constant on sensor 24.

The control signal 39 is now transmitted identically as control signal 39' or 39", via line 48, also to the heating controls of the other processing stations 5 and 5', respectively As a result, the temperatures of godets 22' and 22" of these other processing stations are adjusted identically to that of the reference station.

Furthermore, the control signal 39 is transmitted to a local evaluation unit 46 and compared there with a desired value. This comparison may also be made with a tolerance range on both sides of desired value S. Therefrom, a quality signal Q1 is obtained for the quality of the control. Likewise, in the other processing stations, the yarn tension is measured by corresponding sensors 24' and 24", and each measured value is supplied to a local evaluation unit 46' and 46", and compared therein with the yarn tension signal obtained in reference station 4. From this comparison, quality signals Q2 and Q3 are determined.

One would now expect that the measured value remains likewise constant in these stations. However, it is also possible that on processing stations 5 or 5' disturbances occur, which are bound to lead to a discontinuation of the production process in the particular processing station.

Instead of emitting quality signals Q2 or Q3 from the local evaluation units 46' or 46", it is likewise conceivable to return the measured yarn tension signals to a central evaluation unit in accordance with FIG. 1.

Figure 4:
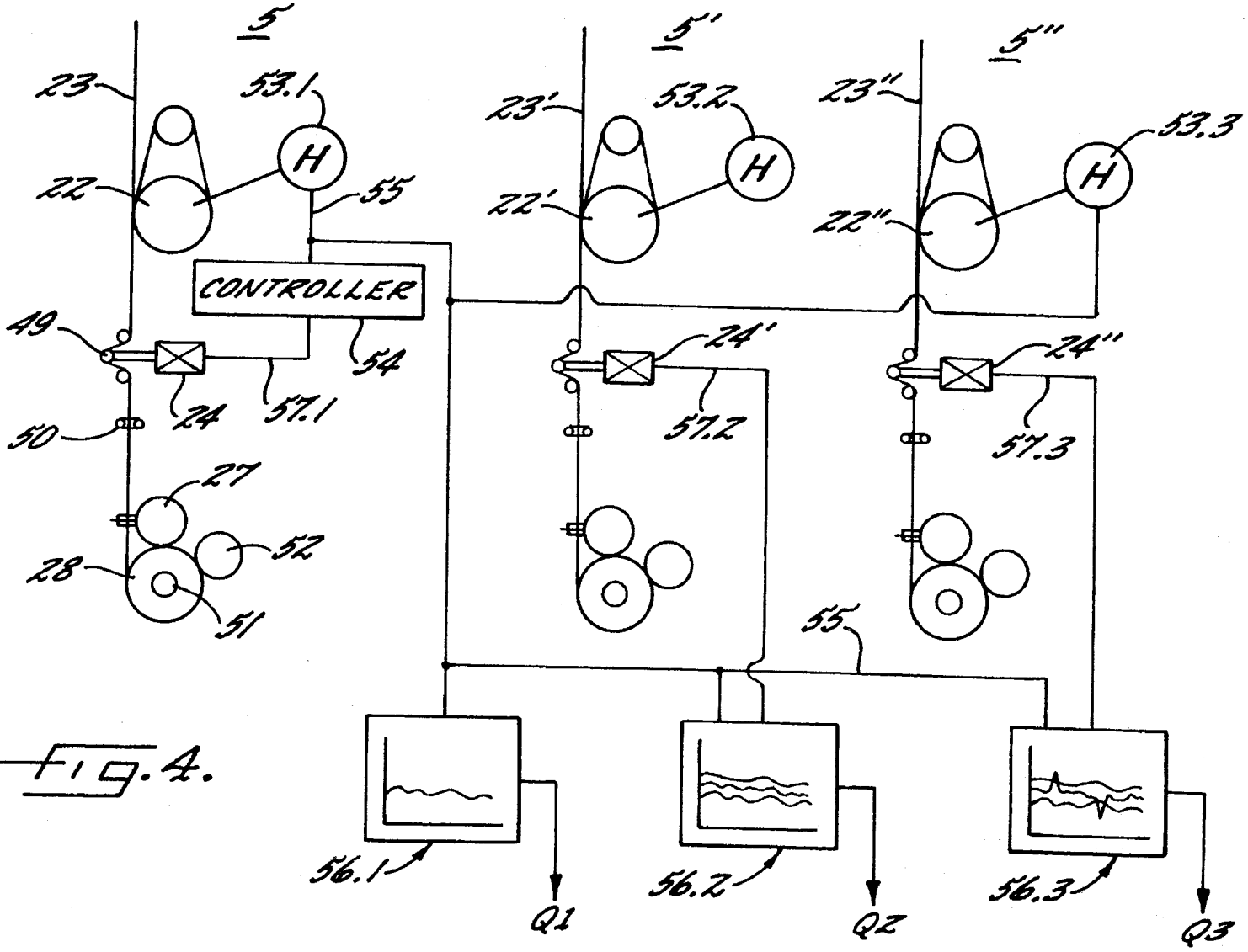
FIG. 4 illustrates a schematic layout of three processing stations.

FIG. 4 is a schematic view of three processing stations 5, 5', and 5". In each of these processing stations a yarn 23, 23', and 23" is produced, which is a synthetic filament yarn of, for example, polyester. Shown as processing station is the lower portion of a spinning position. Same may however be likewise a processing station in any desired other machine for producing a synthetic filament yarn, for example, a false twist crimping machine. Within the scope of the present application, production is understood to include not only the spinning, but also the processing of the yarn. In each of the processing stations, the yarn is withdrawn by a godet 22, 22', 22" from its actual production zone. Thereafter, each yarn passes through a yarn tension sensor with yarn deflection guides 49 and the actual sensor 24. Then, the yarn advances to an apex yarn guide 50. Downstream of apex yarn guide 50, the yarn is reciprocated by traversing mechanism 27 and thereby wound on a package 28. The package 28 is formed on a winding spindle 51. The winding spindle 51 is driven such that while being formed, the package has a constant circumferential speed. To this end a measuring roll 52 is used which is in peripheral contact with the package.

The godets 22, 22', 22" are heated, each by a heating device 53.1, 53.2, 53.3. This heating allows to influence the yarn tension which is measured by the respective sensor 24. In processing station 5, the measured yarn tension is controlled simultaneously. The processing station 5 is therefore used as a reference station. The measured parameter, namely the yarn tension, is supplied to a controller 54. The controller 54 generates a control signal 55 for heating control 53.1 as a function of a desired value S. This control with temperature adjustment of godet 22 allows to keep the yarn tension constant on sensor 24.

The control signal is now supplied in identical manner also to heating controls 53.2 and 53.3. As a result, the temperatures of godets 22' and 22" of these other processing stations are adjusted in a manner identical with the reference station.

The control signal 55 is further compared in a computer 56.1 of reference station 5 with the desired value S or a tolerance range on both sides of the desired value. From this comparison, a quality signal is obtained for the quality of the control. Likewise, in the other processing stations, the yarn tension is now measured by corresponding sensors 24', 24", and the measured value is input via a line 57.2, 57.3 in a computer 56.2, 56.3 associated to each processing station. One would now have to expect that the measured value remains likewise constant on these stations. However, it is also possible that on processing stations 5' or 5" disturbances occur, as is shown for processing station 5" by an indicated recording of computer 56.3. In the computer, the measuring signal of the individual processing stations 5' and 5" is again compared with a desired value. To this end, a mean value may be formed from the measuring signal. It will then be monitored, whether or not the measured values leaves a predetermined tolerance range extending on both sides of the mean value. Likewise however, it will be monitored whether or not the mean value leaves a predetermined tolerance range. As an alternative or in addition, it is possible to use as reference signal control signal 55 or a tolerance range extending on both sides of the control signal. This alternative is shown in the drawing.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A method for controlling the quality in the production of a plurality of yarns in a corresponding number of identical processing stations which define a production line, comprising the steps of:

continuously and simultaneously measuring at least one process parameter (10, 10', 10") in each processing station of the production line;

comparing the process parameter (10, 10', 10") or a characteristic value derived from the process parameter (10, 10', 10") of a least one selected processing station (4) with a corresponding desired value or a desired characteristic value;

determining a control signal on the basis of the comparison;

supplying the determined control signal to all processing stations and controlling an identical control element at all of the processing stations; and determining a quality value for each processing station by correlating at least one process parameter measured therein with a reference signal.

2. The method as defined in claim 1, wherein at least one additional process parameter (7, 8, 9, 11) is measured in said at least one selected processing station (4), and wherein all measured process parameters (7–11) and/or the characteristic values derived therefrom are correlated with one another in said one selected processing station (4) with predetermined interdependencies.

3. The method as defined in claim 2 wherein the control variables (12, 13, . . . ) of the individual process parameters are input values for a control circuit (17) of said one selected processing station (4).

4. The method as defined in claim 3, wherein the control variables (12, 13, . . . ) are identical in all processing stations (5, 5', . . . ).

5. The method as defined in claim 1 wherein tolerance ranges surrounding respective mean values of the measured parameters are predetermined as permissible value ranges of the process parameters in said one processing station (4) and the remaining processing stations (5, 5', . . . ).

6. The method as defined in claim 5, wherein upon leaving a permissible value range of one of the process parameters in said one processing station (4) and/or in one or more of the remaining processing stations (5, 5', . . . ), the respective processing station is stopped or identified as being defective.

7. The method as defined in claim 1, wherein the product-specific properties to be realized by the production process are predetermined in all processing stations (4, 5, 5', . . . ), as well as with regard to the quality of the produced yarn or the produced package in each individual processing station.

8. The method as defined in claim 2 wherein use is made of different process parameters/characteristic values describing or determining the respective process control, or combinations of at least two process parameters/characteristic values for monitoring the course of the process.

9. The method as defined in 8 wherein in all processing stations (5, 5', . . . ) of the production line the measurement of the yarn tension (10, 10', 10") is used as process parameter.

10. The method as defined in claim 8 wherein the measurement of the package contour (7) is used as process parameter in said one processing station (4).

11. The method as defined in claim 8 wherein the measurement of the K value, i.e. the ratio of traversing frequency to rotational speed of the package, by means of suitable measuring methods (8) is used as process parameter in said one processing station (4).

12. The method as defined in claim 8 wherein the determination of the modulus of elasticity (9) of the produced yarns is used as process parameter in said one processing station (4).

13. The method as defined in claim 8 wherein several sensors of the same type or same combinations of different sensors are arranged simultaneously at different points in the yarn path within each processing station (4, 5, 5', . . . ).

14. The method as defined in claim 8 wherein the acquisition of typical occurrences from typical signal patterns (11) or combinations of typical signal patterns of the conceivable measuring signals by means of suitable comparison methods are used as process parameters in said one processing station (4).

15. The method as defined in claim 1 wherein different or all control devices in the particular production process can be controlled by a central input of identical control variables (12, 13, . . . ) in all processing stations (5, 5', . . . ).

16. The method as defined in claim 1 wherein records for documenting the production quality are associated automatically to each package during the production process.

17. The method as defined in claim 1 wherein said reference signal comprises a preset desired value.

18. The method as defined in claim 1 wherein said reference signal for said one selected processing station comprises a preset desired value.

19. The method as defined in claim 18 wherein said reference signal for all processing stations other than said one selected processing station comprises said control signal.

20. The method as defined in claim 18 wherein said reference signal for all processing stations other than said one selected processing station comprises a mean value of said one process parameter of the associated processing station.

* * * * *